United States Patent [19]

Humphries

[11] Patent Number: 4,901,878

[45] Date of Patent: Feb. 20, 1990

[54] RIGID FLUID CONTAINER

[75] Inventor: Romilly H. Humphries, Dover, Mass.

[73] Assignee: S.A.Y. Industries, Inc., Leominster, Mass.

[21] Appl. No.: 239,699

[22] Filed: Sep. 2, 1988

Related U.S. Application Data

[63] Continuation-in-part of Ser. No. 26,024, Mar. 16, 1987, abandoned.

[51] Int. Cl.[4] ..... B65D 83/00; B65D 23/10; B65D 25/46

[52] U.S. Cl. ..... 220/94 A; D9/376; 215/1 C; 222/465.1; 222/530

[58] Field of Search ..... D9/375, 376, 378, 380, D9/381, 387, 442, 443, 449, 450; 206/229; 215/1 C, 10, 100 A; 220/94 A; 222/465.1, 466, 472, 475, 529, 530, 566, 567, 572, 574

[56] References Cited

U.S. PATENT DOCUMENTS

| | | | |
|---|---|---|---|
| D 212,670 | 11/1968 | Linn, Jr. | D9/376 |
| D 220,679 | 5/1971 | Finkel | D9/375 |
| D 237,255 | 10/1975 | Plummer | D9/376 |
| 1,838,468 | 12/1931 | Thompson | 222/475 |
| 3,583,590 | 6/1971 | Ferraro | 215/10 |
| 4,199,140 | 4/1980 | Ferretti | 222/465.1 |
| 4,236,655 | 12/1980 | Humphries | 222/465.1 |
| 4,243,162 | 1/1981 | Klygis | 222/530 |
| 4,351,454 | 9/1982 | Maynard, Jr. | 222/529 |

*Primary Examiner*—Jimmy G. Foster
*Attorney, Agent, or Firm*—David Wolf

[57] ABSTRACT

A container for fluids comprising a single piece, integrally formed, thin walled, self-supporting member defining a non-collapsible rigid hollow body of fixed shape having orthogonally related end walls with a first pair of the adjacent orthogonally related end walls spaced by a wall segment at an acute angle to each forming a hand grip section, and a second pair of orthogonally adjacent end walls opposite the first pair and having an elongated nozzle extending from one of the end walls adjacent the intersection of the second pair with the nozzle having means for flexing to and from a storage position adjacent the one of the end walls.

21 Claims, 4 Drawing Sheets

RIGID FLUID CONTAINER

PRIOR APPLICATIONS

This application is a continuation-in-part of application Ser. No. 026,024 filed Mar. 16, 1987 entitled Rigid Fluid Container now abandoned.

SUBJECT MATTER OF THE INVENTION

The present invention relates to an improvement in a fluid dispensing storage container used primarily for dispensing fluids into hard to reach locations, typically found in automobiles and the like.

BACKGROUND OF THE INVENTION

A wide range of fluid containers have been designed and used for storing and dispensing fluids into hard to reach places. Many years ago delivering fluid into hard to reach locations was achieved by using a pouring spout in combination with a container such as an oil can. Shortly thereafter the liquid dispenser and the pouring spout were combined. U.S. Pat. No. 1,838,468, issued to Thompson on Dec. 29, 1931, illustrates such a combination having a dispensing container and a flexible pouring spout integrally connected to it. Such a configuration also made use of an integral handle and mechanism for locking the pouring spout when not in use. In addition to the Thompson U.S. Pat. No. 1,193,895, issued June 13, 1933 to Paull, also shows a container with a flexible nozzle and a mechanism for securing the flexible nozzle to the container. Thereafter features of this combination of dispenser and pouring spout were translated into containers made of plastic. Initially, many of these containers did not embody the flexible pouring spout exemplified by the Thompson reference. Exemplary of the wide range of these plastic containers are U.S. Pat. No. D. 220,679 and U.S. Pat. No. D. 237,255. Thereafter liquid containers having flexible pouring spouts became common, as exemplified by U.S. Pat. No. 4,351,454, issued Sept. 28, 1982 to Maynard, and U.S. Pat. No. 4,243,162, issued Jan. 6, 1981 to Klygis. Some of these also provided stacking mechanisms and means for locking the pouring spout into a fixed position. The common usage of such flexible containers was also exemplified by applicant's earlier U.S. Pat. No. 4,236,655, issued Dec. 2, 1980. Other patents that made use of flexible pouring spouts permanently secured to the container are disclosed in U.S. Pat. No. 3,583,590, and include U.S. Pat. Nos. 1,913,895; 2,957,614; 2,987,228; 3,181,743; 3,392,887; and 3,476,111. Those prior art disclosures involve complicated and expensive methods of fabrication, and cumbersome ways of attaching the fastener to the spout.

The applicant's prior U.S. Pat. No. 4,236,655 relates primarily to a container intended for large amounts of fluid such as 1 and 2 gallons, because of its size it required, among other things, an integrally arranged handle configuration which provided structural strength in a distinctly formed handle or support means. Other efforts to attach a flexible tube to a container have been attempted in other art including, for example, in the disposable syringe art, as exemplified by U.S. Pat. No. 3,476,111, issued Nov. 4, 1969 to Matheson. Other efforts to make plastic containers that are stackable but which are not particularly designed for pouring fluid include U.S. Pat. No. 3,583,590, which issued June 8, 1971 to Ferraro, and U.S. Pat. No. 4,199,140, which issued Apr. 22, 1980 to Ferretti. These latter two references are relatively unrelated to the specific problems dealt with in the present invention but do make reference to plastic containers which are nestable with one another.

The locking system illustrated in U.S. Pat. No. 4,236,655 and in particular in FIGS. 3 and 4 has, insofar as the applicant has been aware, never been commercially used, because the design is impractical for commercial uses. Locking systems which have been adopted for use with 5 and 4 quart plastic containers having a flexible nozzle, having an appearance generally similar to that illustrated in U.S. Pat. No. 4,236,655 which have been used commercially but apparently have never been disclosed in a printed publication are illustrated in FIGS. 6 and 6*a*. In this arrangement, as hereafter described, locking members are integrally formed in the wall of the molded container to provide a delta like channel, adapted to receive the delta shaped dog on the nozzle through either end of this channel. In actual use, this arrangement has been found to be impractical from a point of view of automated manufacture. It has also limited utility in use because it does not necessarily provide a better locking mechanism for a variety of reasons.

SUMMARY OF INVENTION

The object of the present invention is to provide a container which is particularly useful for storing and dispensing small quantities of fluids, as for example 1 quart or less. A further purpose of the present invention is to provide an improved fluid container that permits easy handling of the container in hard to reach places, without the likelihood of dropping or spilling, and in addition without the need of unusual shapes or excessive amounts of plastic material.

In accordance with the invention there is provided a container for fluids comprising a single piece, integrally formed, thin walled, self-supporting member defining a non-collapsible rigid hollow body of fixed shape having orthogonally related end walls spaced by a wall segment at an acute angle to each forming a hand grip section, and a second pair of orthogonally adjacent end walls opposite the first pair and having an elongated nozzle extending from one of the end walls adjacent the intersection of the second pair with the nozzle having means for flexing to and from a storage position adjacent the end wall from which the nozzle extends.

The end wall having the nozzle extending therefrom preferably comprises a pair of stepped wall sections continuously connected at an angle by an intermediate wall section, the nozzle extending outwardly in a pouring position from the lower one of the stepped wall sections and being adapted to be flexed to a vertical storage position adjacent the upper one of the stepped wall sections. The intermediate wall section is typically substantially parallel to the wall segment which is spaced between the first pair of orthogonally related end walls.

Preferably, the container includes ribs which extend continuously down from the end of the intermediate wall and along the sides of the lower one of the stepped wall sections at the same angle as the intermediate wall section is relative to the stepped wall sections. The container typically further includes a mechanism for securing the nozzle in a vertical storage position adjacent the upper one of the stepped wall sections.

The invention also provides a container for fluids comprising a single piece integrally formed thin walled self-supporting member defining a non-collapsible, rigid hollow body of fixed shape having an end wall with stepped segments. An elongated tubular nozzle with one end integrally extending from one of the stepped segments, has a flexible segment for flexing, under external forces, from a storage position in which the end of the nozzle remote from the one end is positioned parallel to a second stepped segment remote from the first segment. A mechanism for interlocking the nozzle to the second stepped segment comprises interchangeable components with one component on the nozzle and the other component on the second stepped segment, and with the unstressed distance of the interlockable components from the junction of the one end of the nozzle and the first stepped segment less for the component on the nozzle than for the component on the second stepped segment, whereby interlocking cause the nozzle to be placed under tension.

The rigid hollow body of such container includes a rear end wall opposing the stepped end wall and, opposing top and bottom walls, wherein the top and rear end walls are orthogonally disposed to each other and are spaced by a slanted wall segment at an acute angle to each forming a hand grip section. The stepped wall segments are connected by an intermediate wall section opposing and substantially parallel to the slanted wall segment, and ribs are preferably provided which extend continuously down form the end of the intermediate wall and along the sides of the first stepped wall segment substantially parallel to the slanted wall segment.

The mechanism for securing the nozzle typically includes an interlockable mechanism integrally formed in part on the nozzle and in part on the outset portion of the front end wall, and preferably, such mechanism is integrally attached at a selected position along the length of the nozzle so as to require the stem of the nozzle extending from the inset portion to bend in the direction of the storage position of the nozzle and exert backward frictional resistance force within the interlockable mechanism.

The locking mechanism also features a means for permitting insertion of a dog integrally formed on the nozzle into a slot from one end of the slot only.

The ratio of the diameter of the nozzle to the volume of the rigid hollow body is typically between about 0.75 inches/quart and about 1.25 inches/quart. The diameter of the nozzle is usually between about 0.75 inches and about 1.25 inches and the volume of the rigid hollow body is usually between about 0.75 quarts and about 2.0 quarts.

BRIEF DESCRIPTION OF THE DRAWINGS

FIGS. 6 and 6*a* are respectively top and side elevational view of prior art utilizing a locking mechanism.

DETAILED DESCRIPTION OF THE PREFERRED EMBODIMENTS

Figure 1:
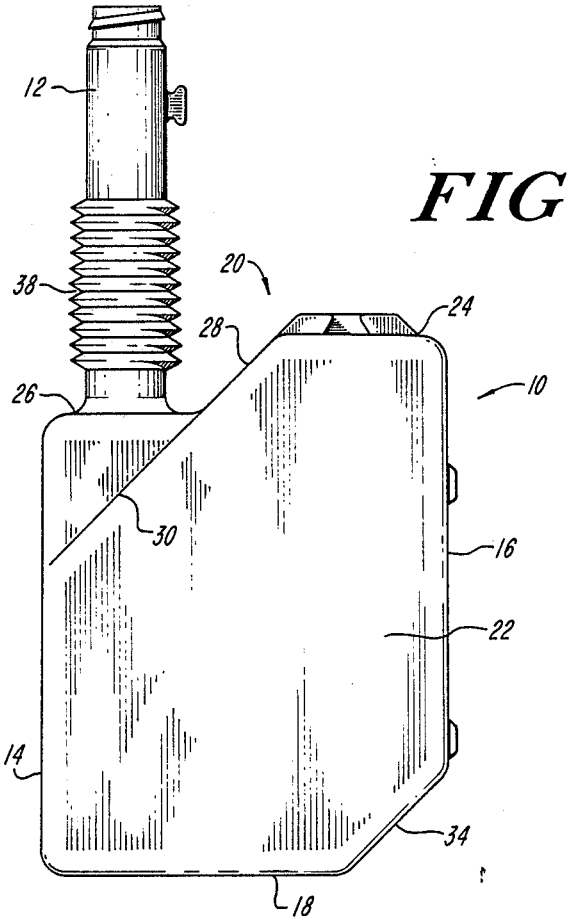
FIG. 1 is a side view of a container according to the invention showing the nozzle extending directly outwardly therefrom in its normal open unflexed state.
Figure 2:
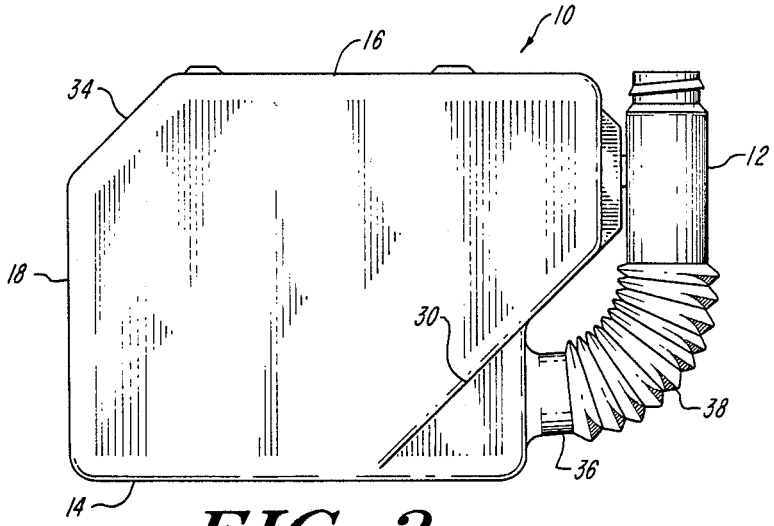
FIG. 2 is a side view of a container according to the invention shown in the nozzle interlocked in its storage position adjacent the front end wall.
Figure 5:
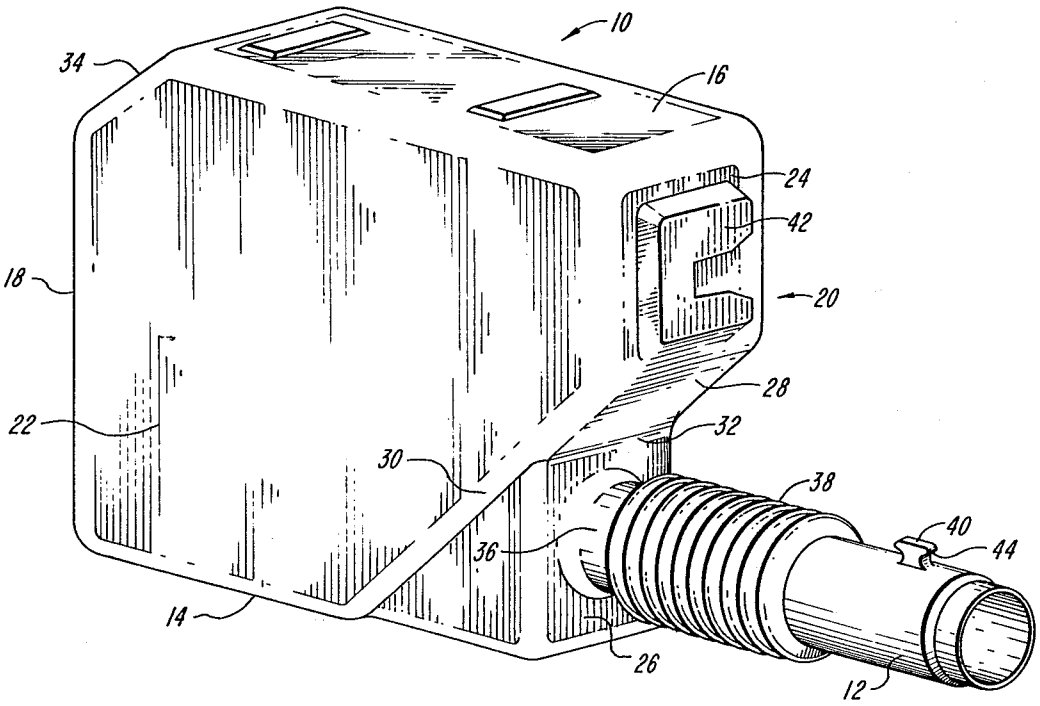
FIG. 5 is a side isometric view of a container according to the invention showing the stepped nature of the front end wall of the container.

There is shown in FIGS. 1, 2 and 5 a container 10, the body of which comprises a rigid hollow box having opposing bottom 14 and top 16 end walls, opposing rear 18 and front 20 end walls, and opposing side 22 walls. The walls of the container 10 are connected at rounded corners and edges.

The front end wall 20 comprises an outset wall segment 24, an inset wall segment 26 and a slanted intermediate wall segment 28 which forms a continuous wall section connecting front wall segments 24, 26. The width of the inset front wall segment 26 from side to side is typically slightly less than the width from side to side between side walls 22 such that a pair of reinforcing ribs 30 are formed along the sides of the inset segment 26. Ribs 30 extend at an angle from the top 32 of wall segment 26 downward to bottom wall 14. At the top 32 of wall segment 26, the ribs 30 merge into and form the side edges of intermediate wall section 28, FIGS. 1, 3, 5.

Top end wall 16 and rear end wall 18 are connected by a slanted rear wall section 34. As shown in FIGS. 1, 2 and 5, top 16 and rear 18 end walls and bottom 14 and front 20 end walls are disposed in substantially perpendicular relationship to each other thus collectively forming a substantially rectangular hollow body having a stepped front end 20 and a slanted upper rear end 34. The merging of ribs 30 with the side edges of wall section 28 form a continuous rib extending from the bottom edge of wall section 24 to bottom end wall 14 and, the angle of such continuous rib is preferably selected to be substantially parallel to the angle of slant of the top rear end wall section 34 which connects top 16 and rear 18 end walls.

Nozzle 12 is integrally formed and protrudes from the outer face of inset wall segment 26. As shown in FIG. 5, the nozzle 12 is in its normal unstressed position and by virtue of its integral formation in the wall segment 26 protrudes horizontally in its normal unstressed state such that the axis of the nozzle 12 is substantially parallel to bottom end wall 14. As shown, the stem 36 of nozzle 12 is located adjacent to and protrudes from the intersection of bottom wall 14 and front wall 20 which is opposite the upper rear slanted wall segment 34. Such opposite upper and lower end corner disposition of slanted wall section 34 and nozzle 12 render wall section 34 ideally useful as a hand grip for pouring fluids stored in container 10 through nozzle 12, FIGS. 1, 2, 5.

Nozzle 12 and the body of container 10 are preferably molded from a rigid flexibly resilient plastic material. The rigid resilience of the plastic material and the integral formation of the stem 36 of nozzle 12 in wall segment 36 impart a resilient bendability to nozzle 12 whereby the entire length of nozzle 12 may be bent about stem 36 by application of force against the axis of the nozzle 12. Additionally nozzle 12 is provided with a pleated elbow section 38 adapted to enable the bending of nozzle 12 along its axis both to a storage position adjacent wall segment 24 as shown in FIGS. 2, 3 and to other pouring positions.

Figure 3:
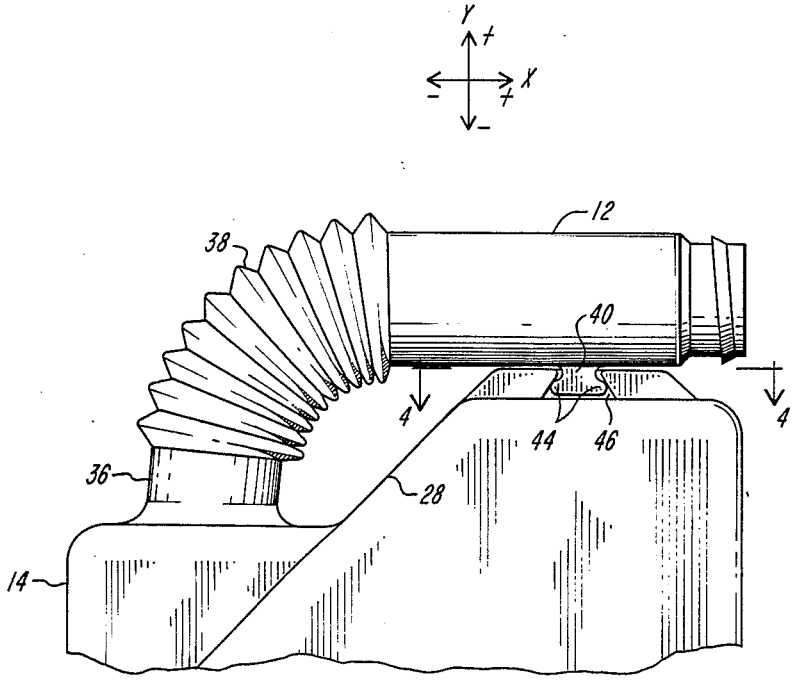
FIG. 3 is a close-up side view of the nozzle and interference lock mechanism engaged so as to hold the nozzle in its storage position.
Figure 4:
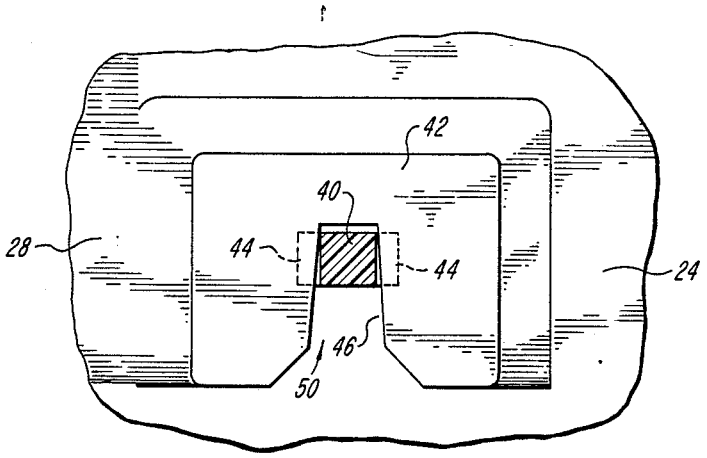
FIG. 4 is a close-up, front end, cross sectional view showing the male component(s) of the interference lock mechanism engaged within the female component of the nozzle's interlocking mechanism.

In order to bend, store and lock nozzle 12 in a storage position as shown in FIGS. 2, 3, the distal end of nozzle 12 is provided with a delta-shaped male interlocking component 40 and the face of outset wall segment 24 is formed with a female interlocking component 42. Together, male 40 and female 42 components comprise an interference lock mechanism. As shown in FIGS. 3 and 4 the male component 40 is delta-shaped with flared ends or detents 44 spaced from nozzle 12. These ends engage undercut portions 46 in the complementary female component 42.

As shown in FIG. 3, the male component 40 is integrally formed at such a point along the nozzle 12 as to require the nozzle 12 to be bent not only about elbow 38 but also about stem 36 in order to position the detents 44 within the aperture 50. When the detents 44 are positioned within complementary aperture 46, the stem 36 exerts a resilient force on nozzle 12 in the −X direction (as viewed in the X-Y diagram forming part of FIG. 3.) in addition to an upwardly resilient force in the +Y direction which is exerted as result of the bending about pleated elbow 38. If the nozzle 12 were bent about elbow 38 at a true 90 degree angle, the male component 40 could not be positioned within complementary aperture 50. The selective placement of component 40 on the nozzle 12 thus acts to require that the nozzle 12 be bent about the stem 36 in order to position component 40 and detents 44 within aperture 50. Such requirement of further bending of the nozzle 12 about stem 36 in order to lock the nozzle 12 in the storage position as shown in FIGS. 2, 3 thus creates a backward frictional tension between the outside surfaces of detents 44 and the undercut 46, in addition to the interference tension which is created between the same surfaces by bending around elbow 38 and the resultant resistance force in the +Y direction which results from such elbow 38 bending.

As shown in FIG. 4 the male component 40 on nozzle 12, is engaged in aperture 50 from one end and is pushed toward the closed end for maximum frictional engagement between detents 44 and undercuts 46. To effect this fit, aperture 50 is tapered from a flared opening toward a closed end with the taper sufficient to permit easy initial insertion and increasing friction engagement on further insertion of the component 40. A resilient resistance of stem 36 to bending around its axis and a resilient resistance of elbow 38 to bending about its axis collectively also serve to create an interlocking interference frictional force between the upper surfaces of detents 44 and lower surfaces of aperture 46 such that nozzle 12 is effectively locked into the storage position shown in FIGS. 2, 3 until the component 40 of nozzle 12 is intentionally released from aperture 50.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A container for fluids comprising a single piece, integrally formed, thin walled, self-supporting member defining a non-collapsible rigid hollow body of fixed shape having orthogonally related end walls spaced by a wall segment at an acute angle to each forming a hand grip section, and a second pair of orthogonally adjacent end walls opposite said first pair and having an elongated nozzle extending from one of said end walls adjacent the intersection of said second pair with said nozzle having means for flexing to and from a storage position adjacent said one of said end walls.

2. The container of claim 1 wherein said one of said end walls having the nozzle extending therefrom comprises a pair of stepped wall sections continuously connected at an angle by an intermediate wall section, said nozzle extending outwardly in a pouring position from the lower one of said stepped wall sections and being adapted to be flexed to a vertical storage position adjacent the upper one of said stepped wall sections.

3. The container of claim 2 wherein said intermediate wall section is substantially parallel to said wall segment spaced between said first pair of orthogonally related end walls.

4. The container of claim 3 further including ribs extending continuously down from the end of said intermediate wall and along the sides of said lower one of said stepped wall sections at said angle.

5. The container of claim 3 further including means for securing said nozzle in the storage position adjacent said upper one of said stepped wall sections.

6. A container as set forth in claim 5 wherein said means for securing said nozzle in said storage position includes a male component formed on said nozzle and a female component formed in said upper one of said stepped wall sections.

7. A container as set forth in claim 6 wherein said male component has a delta shape, and said female component is formed with a flared opening at open end and closed at the other and having an undercut shaped to receive and frictionally engage said delta shape as it is moved toward the closed end.

8. A container as set forth in claim 1 wherein the distance between opposite ones of said end walls is greater than the width of said container.

9. A container for fluids comprising a single piece integrally formed thin walled self-supporting member defining a non-collapsible, rigid hollow body of fixed shape having an end wall with stepped segments, an elongated tubular nozzle with one end integrally extending from one of said stepped segments, said nozzle having a flexible segment permitting said nozzle to be flexed under external forces from a storage position in which the end of said nozzle remote from said one end is positioned parallel to a second stepped segment remote from said first segment, and means for interlocking said nozzle to said second stepped segment comprising interengagable components with one component on said nozzle and the other component on said second stepped segment and with the unstressed distance of said components from the junction of said one end of said nozzle and said first stepped segment less for the component on said nozzle than for the component on said second stepped segment whereby interlocking causes said nozzle to be placed under tension.

10. The container of claim 9 wherein the rigid hollow body includes a rear end wall opposing said stepped end wall and, opposing top and bottom walls, said top and rear end walls being orthogonally disposed to each other and being spaced by a slanted wall segment at an acute angle to each forming a hand grip section.

11. The container of claim 10 wherein said stepped wall segments are connected by an intermediate wall section opposing and substantially parallel to said slanted wall segment.

12. The container of claim 11 further including ribs extending continuously down form the end of said intermediate wall and along the sides of said first stepped wall segment substantially parallel to said slanted wall segment.

13. A container for fluids comprising:

a single piece, integrally formed, thin-walled, self-supporting member defining a non-collapsible rigid hollow body of fixed shape having rigid continuous substantially flat side walls, self-supporting top bottom end walls, and self supporting rear and front end an elongated tubular nozzle integral with and extending from an inset portion of said front end wall, said nozzle being adapted to be moved between storage pouring positions, said nozzle having a flexible segment being adapted to remain in a substantially rigid horizontal position extending outwardly from said container when in a pouring position and adapted to be flexed to other pouring positions when under the influence of an external force;

said front end wall comprising said inset an portion, an outset portion and a slanted portion extending between said inset and outset portions, said outset portion of said front end wall extending forwardly beyond the inset portion such that when said nozzle is in its storage position the free end of the nozzle is vertically adjacent to said outset portion and the sharpness of the bend in said nozzle required to store it adjacent to said outset portion is reduced and such that the major portion of said nozzle is substantially parallel to said rear end wall;

said top and rear end walls being connected by a second slanted wall section opposing said slanted portion of said front end wall, said second slanted wall section forming a handle means; and, means for securing said nozzle in said storage position adjacent said outset portion of said front end wall.

14. The container of claim 13 wherein said inset portion of said front end wall has thickness smaller than said outset portion such that said slanted portion of said front end wall extends continuously in wall from between said outset portion and said inset portion and in rib form between the top of said inset portion and said bottom end wall.

15. The container of claim 13 wherein said second slanted wall section is substantially parallel to said slanted portion of said front end wall.

16. The container of claim 13 wherein said means for securing the nozzle includes interlockable means integrally formed in part on said nozzle and in part on said outset portion of said front end wall.

17. The container of claim 16 wherein said interlockable means is integrally attached at a selected position along the length of said nozzle so as to require the stem of said nozzle integrally extending from said inset portion to bend in the direction of said storage position of said nozzle and exert backward frictional resistance force within said interlockable means.

18. The container of claim 13 wherein the ratio of the diameter of the nozzle to the volume of said rigid hollow body is between about 0.75 inches/quart and about 1.25 inches/quart.

19. In a container having an integrally formed flexible, elongated nozzle extending therefrom with said nozzle adapted to be flexed to and from a storage position adjacent a wall of said container, means for locking said nozzle in said storage position including a male and female component with one of said components formed on said nozzle and the other formed on said wall, said female component including an opening tapering from an open wide end toward a closed end and said male component having a cross sectional shape to frictionally engage said opening as said male component is moved toward said closed end.

20. A container as set forth in claim 19 including said male component having a delta shaped and said opening having an undercut to engage said delta shape.

21. A container as set forth in claim 20 wherein said male component is integrally formed on said nozzle and said female component is integrally formed on said wall.

* * * * *